US009010487B2

(12) United States Patent
Cruz

(10) Patent No.: US 9,010,487 B2
(45) Date of Patent: Apr. 21, 2015

(54) SAFETY LINE ANCHORING SYSTEM

(76) Inventor: Arthur V. Cruz, Watsonville, CA (US)

( * ) Notice: Subject to any disclaimer, the term of this patent is extended or adjusted under 35 U.S.C. 154(b) by 415 days.

(21) Appl. No.: 12/890,958

(22) Filed: Sep. 27, 2010

(65) Prior Publication Data

US 2012/0073900 A1 Mar. 29, 2012

(51) Int. Cl.
*A62B 35/00* (2006.01)
*E04G 21/32* (2006.01)

(52) U.S. Cl.
CPC ..... *E04G 21/3276* (2013.01)

(58) Field of Classification Search
CPC ..... A62B 35/04; E04G 3/26
USPC ..... 182/3, 45
See application file for complete search history.

(56) References Cited

U.S. PATENT DOCUMENTS 1,413,024 A * 4/1922 Harrell ..... 411/243
2,087,176 A * 7/1937 Webb ..... 119/787
2,488,641 A * 11/1949 Seawright ..... 108/94
2,529,861 A * 11/1950 Angell et al. ..... 248/656
2,725,853 A * 12/1955 Nordheim ..... 119/789
4,015,827 A * 4/1977 Brand ..... 256/59
4,171,032 A * 10/1979 Woolslayer et al. ..... 182/3
4,969,232 A * 11/1990 Michel ..... 16/350
5,011,106 A * 4/1991 Cody ..... 248/237
5,253,967 A * 10/1993 Orban et al. ..... 411/432
5,699,875 A * 12/1997 Dugan ..... 182/3
5,713,695 A * 2/1998 Rogers ..... 404/25
5,758,742 A * 6/1998 Chiou et al. ..... 182/3
5,850,889 A * 12/1998 Rexroad et al. ..... 182/3
5,964,316 A * 10/1999 Roy ..... 182/3
5,971,668 A * 10/1999 Miller ..... 405/259.1
6,412,230 B1 * 7/2002 Zambelli et al. ..... 52/27
6,412,598 B1 * 7/2002 Mackinnon ..... 182/3
6,457,895 B1 * 10/2002 Salman ..... 403/2
6,612,631 B1 * 9/2003 Pearl ..... 294/215
6,695,095 B1 * 2/2004 Franke ..... 182/3
6,712,330 B1 * 3/2004 Damiano ..... 248/519
6,779,316 B2 * 8/2004 Carroll ..... 52/698
6,779,630 B2 * 8/2004 Choate ..... 182/36
6,868,647 B2 * 3/2005 Poldmaa ..... 52/749.12
7,048,090 B2 * 5/2006 Dean et al. ..... 182/3
7,114,872 B2 * 10/2006 Alba ..... 403/78
D531,486 S * 11/2006 Ferris ..... D8/354
7,163,083 B2 * 1/2007 Argoud ..... 182/113
7,793,910 B2 * 9/2010 Salman ..... 248/519
2001/0032435 A1 * 10/2001 Austin ..... 52/749.12
2002/0014569 A1 * 2/2002 Pearl ..... 248/499
2002/0079164 A1 * 6/2002 Choate ..... 182/36
2002/0185335 A1 * 12/2002 Verdyk ..... 182/3
2004/0010993 A1 * 1/2004 Meadowcroft ..... 52/297
2004/0081793 A1 * 4/2004 Byrne ..... 428/99
2004/0120759 A1 * 6/2004 Altman ..... 403/374.3

(Continued)

*Primary Examiner* — Katherine Mitchell
*Assistant Examiner* — Candace L Bradford
(74) *Attorney, Agent, or Firm* — Donald R. Boys; Central Coast Patent Agency, Inc.

(57) ABSTRACT

A safety line anchor system is provided and includes an elongate member including a threaded stud at one end for threading the member on to a threaded opening in a trench plate, a flange fixed to the stud end of the member above the stud base, the flange having two or more openings provided there through for accepting two or more stabilization bolts, a freely rotable platform attached to the end of the elongate member opposite the stud end, the platform including two or more slots cut there through for accepting safety line attachments, and a crane handle fixed to the rotable platform, the crane handle for accepting a crane hook.

3 Claims, 5 Drawing Sheets

(56) References Cited

U.S. PATENT DOCUMENTS

2004/0173405 A1* 9/2004 Bove ..... 182/3
2004/0195041 A1* 10/2004 Vetesnik ..... 182/3
2004/0256176 A1* 12/2004 Argoud ..... 182/45
2005/0098381 A1* 5/2005 Flaherty ..... 182/3
2005/0204540 A1* 9/2005 Lyon ..... 29/525.01
2005/0269154 A1* 12/2005 Siemienowicz ..... 182/3
2005/0284695 A1* 12/2005 Bergendahl ..... 182/3
2006/0273600 A1* 12/2006 Rohlf ..... 294/64.1
2006/0289233 A1* 12/2006 Flaherty ..... 182/45
2010/0243837 A1* 9/2010 Cox ..... 248/237
2011/0048851 A1* 3/2011 Koneval ..... 182/3
2011/0315474 A1* 12/2011 Wiser ..... 182/3

* cited by examiner

SAFETY LINE ANCHORING SYSTEM

BACKGROUND OF THE INVENTION

1. Field of the Invention

The present invention is in the field of construction and pertains particularly to methods and apparatus for anchoring construction workers who are tethered by fall-protection lifelines during their construction shifts.

2. Discussion of the State of the Art

In the field of construction there are often job-site requirements for workers to work at different elevations at the site, sometimes traversing different elevations frequently. One example of a jobsite having varied elevations might be a trenching operation at a construction site where workers must work around above and descend into a deep trench in order to perform their tasks.

Such workers are required to wear full lifeline harnesses attached to shock absorption or fall-protection Lanyards or lifelines in order to prevent injury or death from falling due to accident. One problem with the current way lifelines and web lanyards are used is that workers tend to attach them ad hoc to any anchoring point that looks secure. For example, a worker may attach one to a hook on a backhoe. In that case the attachment might be secure but a chance exists that an operator will move the backhoe without noticing the lanyard attached to it and the worker attached to the lifeline.

Another problem is that when there are several workers wearing fall-protection harnesses attached to various and sundry anchor points, crossed lines can become an issue. Furthermore, many anchoring points are at ground level such as an eyebolt threaded into a steel plate. A fall protection reel, which is the mechanism that gathers the line in coil and provides frictional braking and shock absorption for fall protection is designed to operate vertically, utilizing gravity, and does not perform well when lying on its side, which results in many ad hoc attachment schemes devised by the workers.

Therefore, what is clearly needed is a lifeline anchoring system that solves the above stated problems in the art.

SUMMARY OF THE INVENTION

The problem stated above is that adequate line safety is desirable for construction workers working in elevation-changing environments such as trench work, bridge work, or other types of construction requiring tethered harness and safety line applications, but many of the conventional means for ensuring line safety in construction, such as anchored shock absorbing lanyards and the like also create potential new safety issues for construction workers. The inventors therefore considered functional elements of a fall protection system for construction workers, looking for components that exhibit adequate safety qualities that could potentially be harnessed to provide fall-protection for construction workers, but in a manner that would not create ad-hock anchoring schemes that promote unsafe situations.

The success of every construction site is enhanced by safe practices, one by-product of which is a reduction of loss of life and injury incurred by workers operating at the site. Most such construction sites having elevation-disparate work areas employ construction workers who must don full-body harnesses connected to fall protective safety lines or shock absorbing lanyards while working in such difficult construction terrains such as trenches or the like, and full-body harnesses, lanyards, cabling systems, and anchor components are typically a part of such apparatus.

The present inventor realized in an inventive moment that if, during construction work, construction workers could be safely tethered to a locally consistent and stable anchoring system, significant reduction is work related injury and death might result. The inventor therefore constructed a unique anchoring system for anchoring lifeline apparatus worn by construction workers that allowed workers to operate in a wide range of elevation-changing construction environments, but constrained anchoring location for lifeline support to safe and secure above ground apparatus. A significant reduction is worker death and injury results, with no impediment to construction efficiency or quality created.

Accordingly, in one embodiment of the present invention, a safety line anchor system is provided and includes an elongate member including a threaded stud at one end for threading the member on to a threaded opening in a trench plate, a flange fixed to the stud end of the member above the stud base, the flange having two or more openings provided there through for accepting two or more stabilization bolts, a freely rotable platform attached to the end of the elongate member opposite the stud end, the platform including two or more slots cut there through for accepting safety line attachments, and a crane handle fixed to the rotable platform, the crane handle for accepting a crane hook.

In one embodiment, the elongate member is a steel post threaded vertically into the trench plate via the threaded stud. In one embodiment, flange includes a relief opening for accepting the threaded stud. In one embodiment each of the stabilization bolts are threaded through openings in the flange, the bolts having locking nuts to prevent drift. In a preferred embodiment, the platform is freely rotable via a ball bearing hub or housing. In another embodiment, the platform is freely rotable via a friction bearing.

In a preferred embodiment, the anchor system supports two or more safety lines attached to workers. In one embodiment, the anchor system further includes a handle fixed to the surface of the elongate member for facilitating carrying of the anchor system. In one embodiment the anchoring system further includes a threaded stud adapter for adapting the size of stud to differing size openings in the trench plate.

According to an aspect of the present invention, a method is provided for establishing a hookup point for a safety line for one or more harnessed workers working in elevation-disparate construction landscapes. The method includes steps for fixing a safety line anchor system onto a trench plate, the system including an elongate member having a freely rotable platform attached to one end and a threaded stud at the opposite end for threading the member on to a threaded opening in the trench plate, (b) stabilizing the system at its threaded position on the trench plate by engaging and tightening two or more stabilization bolts provided at a flange fixed to the stud end of the member above the stud base, the flange having two or more openings provided there through for accepting the stabilization bolts; and (c) attaching the free end of the safety line to an opening provided in the rotable platform.

In one aspect of the method, in step (a) an adapter is used to adapt the threaded stud to fit a specific size threaded opening in the trench plate. In one aspect, in step (a) the elongate member is a steel post. In a preferred aspect, in step (b) each of the stabilization bolts are threaded through openings in the flange, the bolts having locking nuts to prevent drift.

In one aspect of the method, a step is added between steps (b) and (c) for positioning the system fixed to the trench plate adjacent to or spanning over the underground work environment. In a variation of this aspect, the underground work environment is a trench. In another variation of this aspect, the system is positioned via a crane hooked to a crane handle provided on the rotable platform.

BRIEF DESCRIPTION OF THE DRAWING FIGURES

DETAILED DESCRIPTION

The inventor provides a safety line anchoring system for construction workers that serves as a tangle free, portable, and consistently secure anchor point for shock absorbing and/or fall-protection lifelines and lanyards attached to workers working in construction environments with differing elevations of work area. The present invention is described in enabling detail using the following examples, which may describe more than one relevant embodiment falling within the spirit and scope of the present invention.

Figure 1:
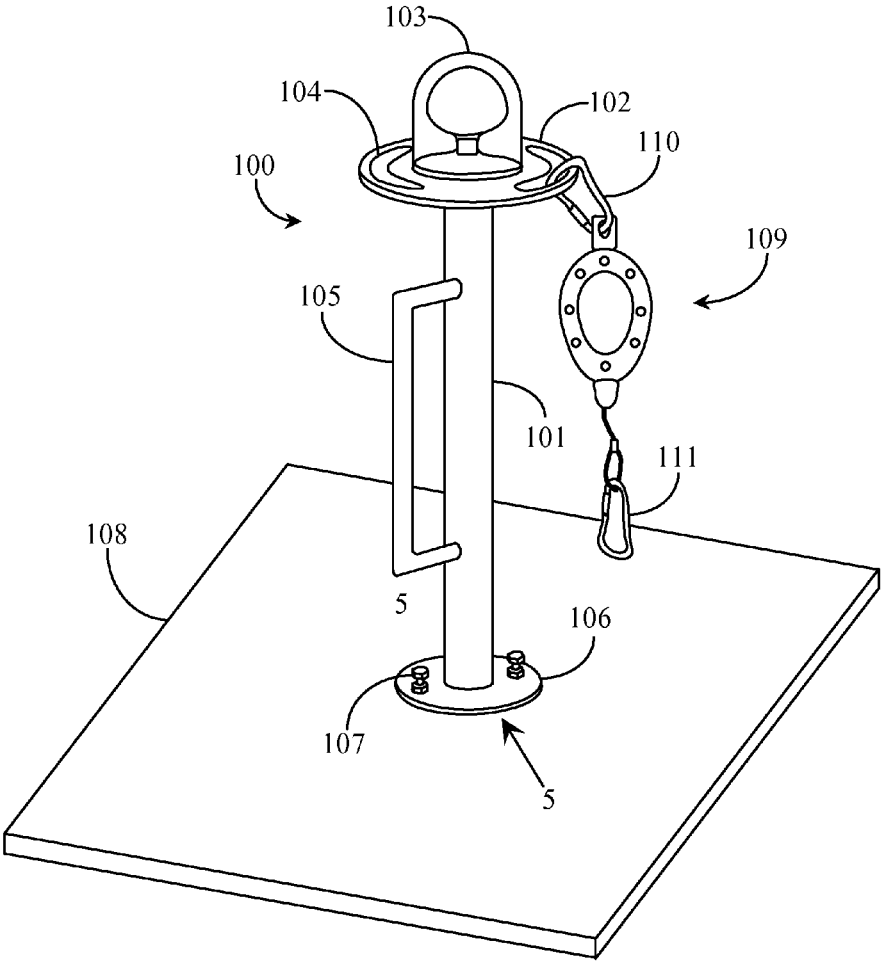
FIG. 1 is a perspective view of a safety line anchor system according to an embodiment of the present invention.

FIG. 1 is a perspective view of a safety line anchoring system 100 according to an embodiment of the present invention. System 100 is adapted to serve as a stable anchoring point for securing lifelines that are attached to harnesses worn by construction workers in the field.

Figure 5:
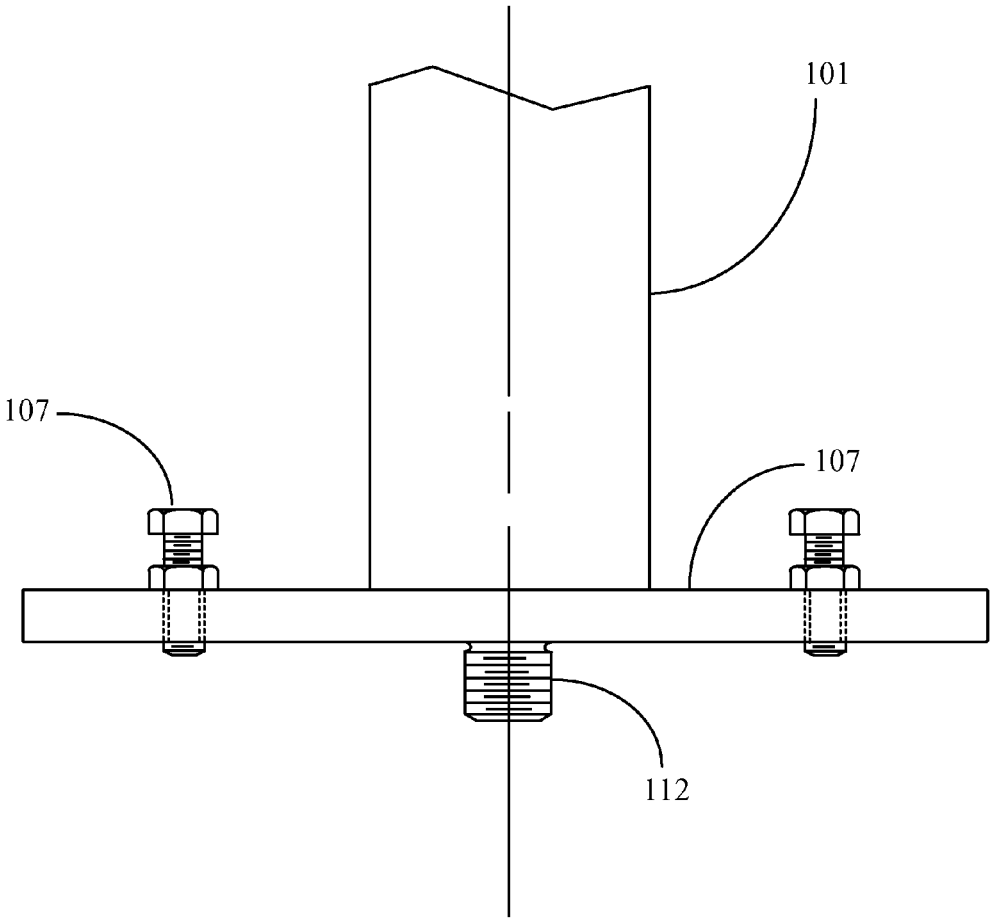
FIG. 5 is a section view taken along section line 5-5 of FIG. 1.

System 100 is embodied as a vertical post 101 that may be manufactured of steel or other durable materials. Standard three-inch diameter, heavy gauge steel pipe is a good candidate material, but other diameter and weight may be used in other embodiments. Post 101 must be of sufficient diameter and strength to hold the weight of two or more construction workers without bending or deforming. Post 101 of system 100 has a male threaded stud 112 on one end adapted for threading the system into a female threaded opening 113 in a heavy gauge steel plate such as a trench-plate 108. Threaded stud 112 is illustrated in FIG. 5, which is an elevation view of the post, flange and stud in the direction of arrow 5 in FIG. 1, with the trench plate not shown. Trench plate 108 is a rectangular steel plate having a thickness that is sufficient for supporting a threaded opening of sufficient depth to accept the threaded stud on the end of post 101 to a secure depth, and to provide a secure anchoring point and platform for workers in trench construction.

Trench plate 108 is sufficiently wide and is of sufficient length to prevent tip-over due to the attached and combined weight of two or more construction workers that will utilize the device during work. Trench plates may be of different lengths and widths such as six by six feet, six by ten feet, and so on. Post 101 has a base plate 106 at one end that is welded or otherwise fixed to post 101 above the threaded stud. The portion of anchoring system 100 to which a worker may attach a lifeline will be at least four feet in elevation when installed on a trench plate. Longer versions may be provided, as well as a version of anchoring system 100 that has a length-adjustable steel post fabricated of heavy gauge steel pipe.

Base plate 106 is circular in this example, but may be of any geometric shape without departing from the spirit and scope of the present invention. Base plate 106 includes two or more openings there-through that are adapted by female threading to accept male-threaded stabilizer bolts 107. Each stabilizer bolt 107 may include a locknut to prevent drift in the bolt once it is installed and secured. Stabilizer bolts may be manufactured of high tempered steel for durable strength. Stabilizer bolts are started through the respective openings in base plate 106 and are tightened against the surface of trench plate 108 to stabilize the position of post 101.

A freely rotable anchor plate 102 is provided and mounted to the upper end of post 101 opposite the stud end. Anchor plate 102 is freely rotable about post 101 and in this embodiment is attached to the post via a bearing housing or bearing mechanism that facilitates rotation of the anchor plate about the post, while maintaining suitable strength. Anchor plate 102 may be a steel plate or it may be made of other durable materials that will not bend or deform or break under the combined weight of two or more construction workers. Anchor plate 102 is not required to be freely rotable in order to practice the present invention, but rotation is a definite advantage. Plate 102 may be partially rotatable with stops or it may be non-rotatable about post 101 without departing from the spirit and scope of the present invention. In this example the plate is rotatable for convenience and ease of use.

Anchor plate 102 includes at least two elongated openings or slots 104 provided there-through running in a general direction around the plate near the peripheral edge of the plate. Slots 104 are adapted as anchoring points on anchor plate 102 for attaching lifeline or lanyard fall-protection systems such as a fall-protection system 109 illustrated in this example. Fall-protection system 109 includes a connector 110, also termed a carabineer, attached to a slot 104 on anchor plate 102. A lifeline reel, referred to in some construction circles as a YoYo, provides the shock absorption and breaking power to prevent falling that might cause serious injury or death.

A lifeline cable including harness connector (carabineer) is provided with the slack of the cable taken up within the reel. Other types of shock absorbing lanyards and Web Lanyards could be used in place of the system (109) illustrated in this example. A crane handle 103 is fixed onto plate 102 via welding or other secure attachment methods. Crane handle 103 is a steel loop in this example but could be of another durable material sufficient to serve as a lifting point for a crane to pick up the post and trench plate and move it to convenient positions over a trench in use. In a preferred embodiment post 101 has a convenient carry handle 105 formed and then welded thereto to enable convenient portability of the device when not fastened to the trench plate.

In use of the present invention, lifeline post assembly 101 is manually threaded onto a suitable trench plate 108. Once the post is threaded to maximum depth, stabilization bolts 107 are engaged and tightened to prevent thread-drift at the post stud exemplified by the post eventually unthreading and becoming loosely threaded onto the plate. It is important to note herein that other mechanisms for securing post 101 to trench plate 108 are possible and may be used instead of the current method without departing from the spirit and scope of the present invention.

With post 101 securely in place on the trench plate (108), a crane or some other lift equipment having a hooked cable or a suitable lifting arm with a hook end may lift lifeline anchoring system 100 while it is bolted to trench plate 108 and place it in an appropriate position to be used by construction workers for preventing injuries and death. In a typical scenario construction workers utilizing anchoring system 100 would be working in a trench, an open pit, or some other elevation that requires a safety harness attached to a lifeline. Before starting work the construction workers don a full protective harness. The fall protective lanyard 109 is attached at its fixed-length end directly to anchor plate 102 using carabineer 110 attached to slot 104.

The opposite end 111 is attached then to the construction worker's full harness (not illustrated) by clamping the carabineer 111 to an attachment ring (not illustrated) located at the rear on the harness. In this way, the workers that must work around openings or descend to lower elevations and in tight quarters are always attached to the same type of consistent anchoring point and not had-hoc locations that can add additional safety hazards. Another advantage of the present invention is that the elevation anchoring point is sufficiently high above ground level to promote better function of the shock absorption lanyards and cable lifelines. These systems do not work well if the direction of pull on the system is horizontal. They are designed to be operated vertically.

Figure 2:
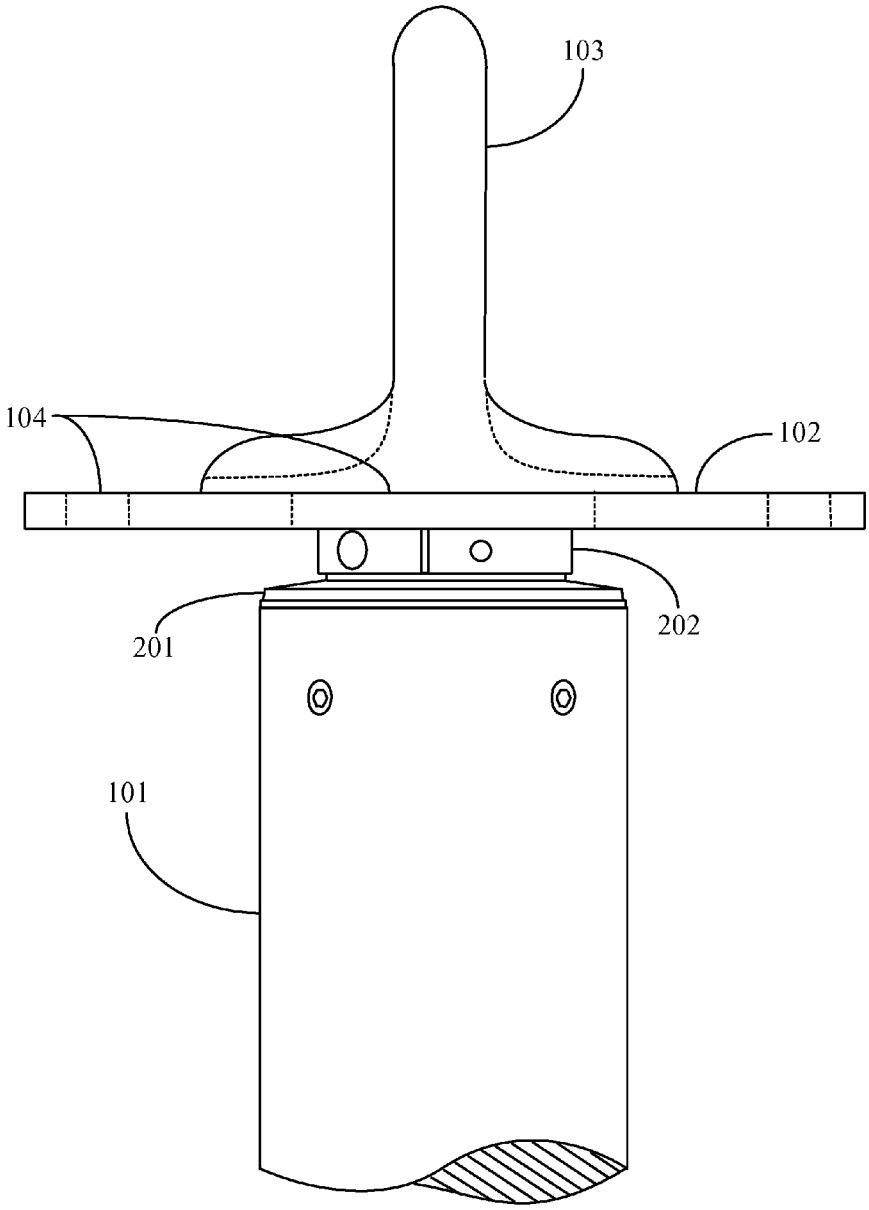
FIG. 2 is a plan view of a freely rotable anchor plate of the system of FIG. 1.

FIG. 2 is an elevation view of the freely rotable anchor plate of the system of FIG. 1. Anchor plate 102 is made freely rotable in this example by virtue of a ball-bearing construction at the junction defining where anchor plate 102 is positioned on the post 101. In this example a bearing housing 201 is provided. Bearing housing 201 is adapted to be fitted within or otherwise to post 101 and secured therein or there-over by setscrew. In this case, the anchor plate is a separate component and has an aperture that may be fitted to the rotable shaft of the bearing mechanism using clamping collar 202. In one variation of this example, anchor plate 102 is connected to a friction plate (not illustrated) that is also connected to post 101 in a rotable manner such that the friction plate allows rotation in either direction but with friction breaking applied to certain rotation patterns, etc. In this case the center portion and lower portions of post 101 are solid steel material but machine out at one end to accommodate the bearing assembly. The interface between plate 102 and post 101 may also be a ball bearing, and the skilled person will recognize that there are a variety of ways known in the art for providing rotation for plate 102 relative to post 101.

Figure 3:
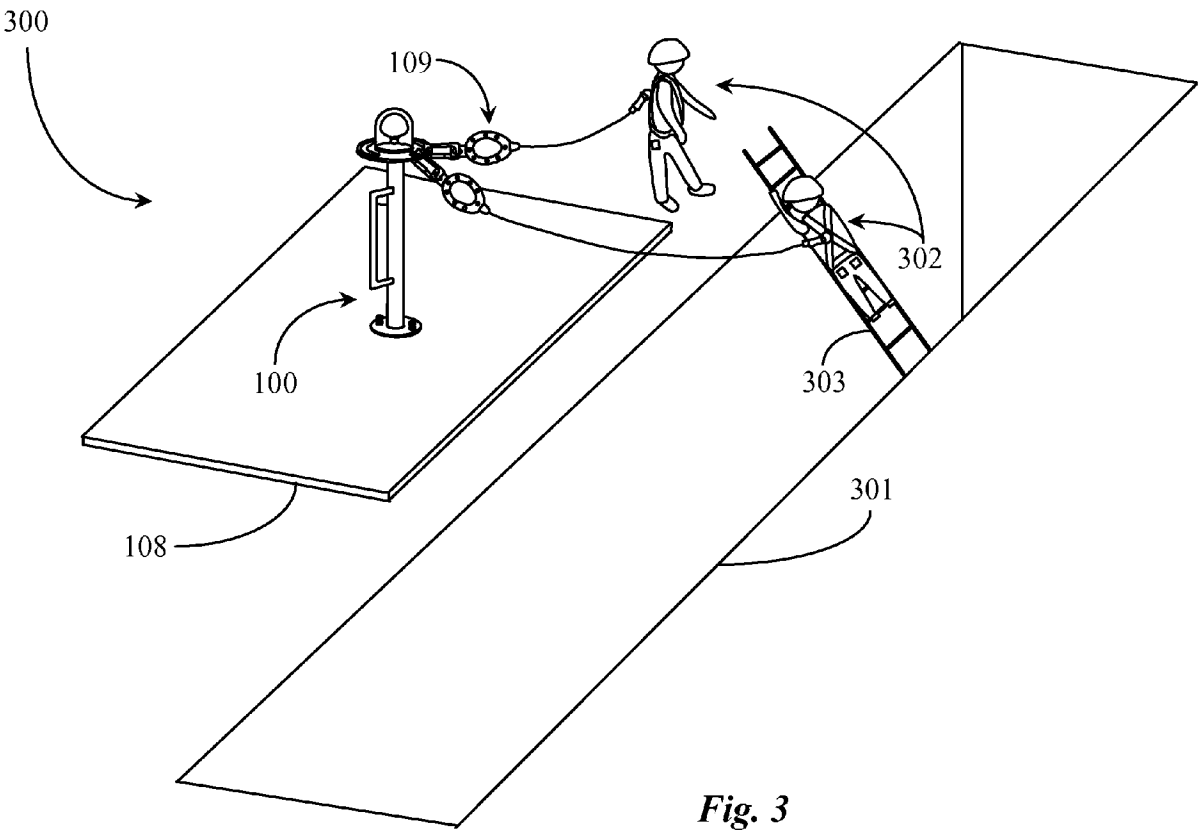
FIG. 3 is a perspective view of a construction site where the system of FIG. 1 is used according to a preferred embodiment of the present invention.

FIG. 3 is a perspective view of a trench construction site 300 where the system of FIG. 1 is used according to a preferred embodiment of the present invention. Construction site 300 is trench site in this example, and trench plate 108 lies adjacent to trench 301 a few feet from the edge of trench 301. Trenches are a frequent requirement at construction sites for such as laying pipelines and electrical cables.

In this example, trench 301 has a ladder set therein to enable construction workers 302 to descend into the trench to perform their tasks. One lifeline-anchoring system 100 is deployed in this example and is centrally bolted to trench plate 108. In this example, trench plate 108 lies adjacent to trench 301 as described above. Each construction worker 302 is hooked up to a fall-protection lifeline or lanyard 109. In the absence of any other features where it might be safe to attach a shock-absorbing, or fall protection lanyard or lifeline, lifeline anchor system 100 provides a very stable and secure anchoring point for the workers. The fall protection lifelines 109 attach to the rear of worker harnesses, typically, to a steel ring located on the back of the harnesses.

In a preferred embodiment, system 100 is used on a trench plate that is placed next to a trench where workers must descend into the trench to perform their tasks. System 100 may also be deployed over a trench or in-between two trenches without departing from the spirit and scope of the present invention. More than one worker may attach to one lifeline anchor plate. More than one lifeline anchor system may be deployed to facilitate workers working at a single trench.

In this example, one construction worker 302 is in the process of descending into trench 301 down a ladder 303 provided for the purpose. Fall-protection lifeline 109 is in place to protect the worker should the worker fall off of the ladder while descending into the trench. A second construction worker 302 hooked up to lifeline anchor system 100 via a fall-protection lifeline 109 is standing adjacent to trench 301 waiting for his turn to descend into the trench. As the workers descend, the angle of the lifeline reel is optimal due to the elevation of the anchor plate of system 100. System 100 elevates the reels above ground level providing an optimum working environment for those reels.

Once workers are at the bottom of trench 301, they will detach from the lifelines and clip then to the ladder or to some other feature in the trench so they do not get tangled by the workers moving about one another inside the trench. To ascend from the trench, the workers attach their lifelines to the ring on their harnesses and climb the ladder out of the trench.

Lifeline anchoring system 100 may be utilized at sites where elevation differences are embodied in features other than trenches. The system may be utilized in open-pit construction sites, sites where there are very steep gradients adjacent to level areas such as levee and dam sites, or in building and bridge construction where elevation differences in the work areas are commonplace.

Figure 4:
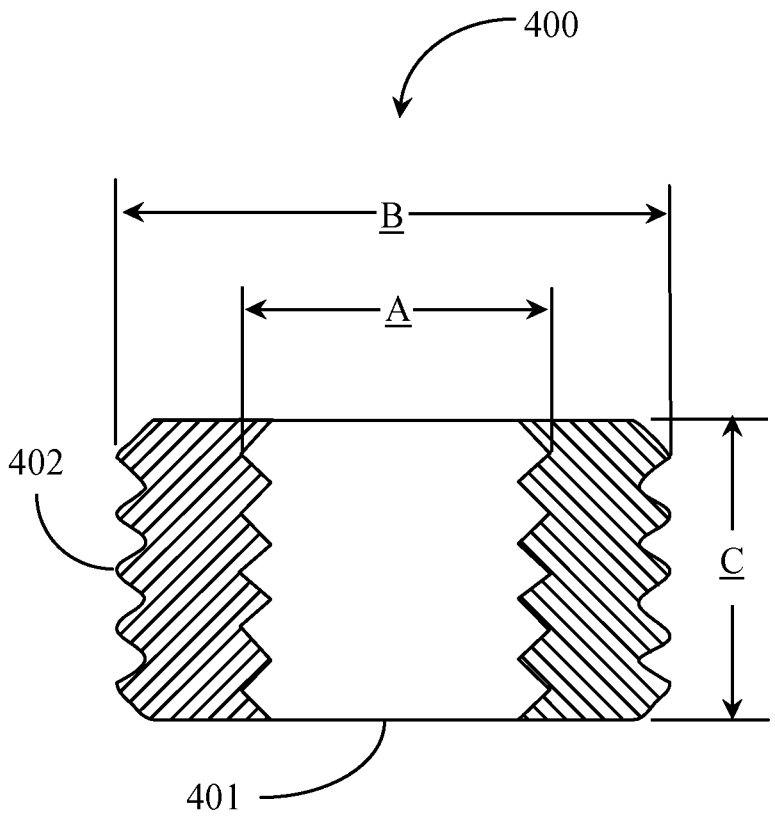
FIG. 4 is a sectioned view of a thread-size adapter used with the safety line anchor system of FIG. 1.

FIG. 4 is a sectioned view of a thread-size adapter 400 used with the safety line anchor system of FIG. 1. In a further variation of the same embodiment of FIG. 1, one or more thread adapters may be provided to adapt the lifeline anchoring system to different size threaded holes that may already exist in a trench plate. In this example adapter 400 is a relatively short steel piece that has an external male thread pattern 402 and an internal female thread pattern 401.

An outside diameter B represents the male thread specification. An inside diameter A represents the adapters inside thread pattern. A height dimension C represents the overall height of the adapter. If, for example, if the threaded stud on the lifeline anchoring system is one-inch coarse thread, then the male thread diameter on the stud would be approximately 0.846 inches. Diameter A on adapter 400 would be 0.864 inches to enable the adapter to be threaded over the stud. If the threaded hole on the trench plate is 1.5-inch coarse thread, then the core diameter of the female thread is approximately 1.534 inches. The adapter then would have a dimension B of approximately 1.505 inches. In a preferred embodiment dimension C would be roughly equal to the length of the stud on post 101. One system may include more than on thread adapter retained with the system as an adapter kit. There may be larger or smaller standards created around the size and critical dimensions of the lifeline anchoring system without departing from the spirit and scope of the present invention.

One with skill in the art of construction practices will appreciate that a consistently secure lifeline anchoring system will prevent attachments of lanyards to ad hoc anchoring points such as points on vehicles, overhead wiring, or cabling, fences, or other non-proven and potentially dangerous anchor points. The system of the present invention may be used in any construction environment where fall-protection apparatus is employed by workers, including in trench and pit construction work, in bridge and overpass construction work, in dam and levee construction work, and in multi-story building construction work.

It will be apparent to one with skill in the art that the lifeline anchoring system of the invention may be provided using some or all of the mentioned features and components without departing from the spirit and scope of the present invention. It will also be apparent to the skilled artisan that the embodiments described above are specific examples of a single broader invention, which may have greater scope than any of the singular descriptions taught. There may be many alterations made in the descriptions without departing from the spirit and scope of the present invention.

What is claimed is:

1. A safety line anchor system comprising:

a rigid steel trench plate at least six feet by six feet in length and width, the trench plate having a centrally-located female-threaded opening;

a vertical post comprising heavy-gauge steel pipe of at least three inch nominal diameter having a central axis and a male threaded stud at a lower end extending in the direction of the central axis, the stud engaging the female threaded opening in the trench plate;

a stabilization flange having a plane orthogonal to the central axis of the vertical post, the flange fixed to a lower end of the vertical post, the flange having two or more female-threaded openings in the direction of the central axis each engaging a stabilization bolt bearing against the trench plate;

a freely rotatable circular anchor plate having a plane orthogonal to the central axis of the vertical post and a diameter substantially larger than the three-inch nominal diameter of the vertical post, the anchor plate positioned near the upper end of the vertical post at a height of at least four feet above the trench plate, the anchor plate mounted to the vertical post by a bearing mechanism facilitating rotation of the anchor plate, the anchor plate including two or more circularly arcuate slots near an outer periphery of the anchor plate for accepting safety line attachments; and a crane handle rigidly joined to the rotatable anchor plate, the crane handle having an opening with a horizontal axis, the opening of sufficient diameter for accepting a crane hook and sufficient strength to support the weight of the safety line anchor system including the trench plate.

2. The anchor system of claim 1 further including a handle fixed to the surface of the vertical post for facilitating carrying of the anchor system.

3. The anchor system of claim 1 further including a threaded stud adapter for adapting the size of stud to differing size openings in the trench plate.

* * * * *